US006790098B1

(12) United States Patent
Chiu

(10) Patent No.: US 6,790,098 B1
(45) Date of Patent: Sep. 14, 2004

(54) CONDUCTING TERMINAL STRUCTURE

(76) Inventor: Hsien-Yu Chiu, P.O. Box No. 6-57, Junghe, Taipei 235 (TW)

( * ) Notice: Subject to any disclaimer, the term of this patent is extended or adjusted under 35 U.S.C. 154(b) by 0 days.

(21) Appl. No.: 10/463,669

(22) Filed: Jun. 18, 2003

(30) Foreign Application Priority Data

Apr. 4, 2003 (TW) ..... 92205369 U

(51) Int. Cl.[7] ..... H01R 13/40
(52) U.S. Cl. ..... 439/733.1; 439/660; 439/325
(58) Field of Search ..... 439/660, 326, 439/325, 733.1, 636, 637

(56) References Cited

U.S. PATENT DOCUMENTS 5,882,230 A * 3/1999 Bricaud et al. ..... 439/630
5,993,234 A * 11/1999 Yodogawa ..... 439/326
6,050,858 A * 4/2000 Liu et al. ..... 439/660
6,171,126 B1 * 1/2001 Wu et al. ..... 439/224
6,183,283 B1 * 2/2001 Kurotori et al. ..... 439/326
6,464,521 B1 * 10/2002 Kurotori et al. ..... 439/325

* cited by examiner

*Primary Examiner*—Tho D. Ta
(74) *Attorney, Agent, or Firm*—Troxell Law Office PLLC

(57) ABSTRACT

A conducting terminal structure according to the invention includes a contact portion serving as an electrically conducting portion, a fastening portion having a dentate shape for securing to the connector, a tenon portion protruding at a center of the conducting terminal, and an extension portion as an elongation of the conducting terminal structure. Wherein, the conducting terminal structure is a formed integral for preventing instability issues caused by stress at various bent portions thereof. In addition, the invention further includes a plurality of fastening members for reinforcing securing effects within the connector.

5 Claims, 14 Drawing Sheets

80

CONDUCTING TERMINAL STRUCTURE

BACKGROUND OF THE INVENTION (a) Field of the Invention

The invention relates to a conducting terminal structure formed as an integral, and more particularly, to a conducting terminal structure for preventing instability issues caused by stress at various bent portions thereof, and for reinforcing securing effects thereof within a connector.

(b) Description of the Prior Art

Connectors are connecting elements and accessories used for electronic signals and power, and are links between all signals. Qualities of connectors affect not only reliabilities of power and signal transmissions, but also operational standards of entire electronic devices. Wherein, conducting terminals at a connector are most crucial in operations of an entire device, and hence strength and design with respect to securing effects of a conducting contact plane and a rear end thereof at a connector remain a vital task.

Computer connectors are classified into two categories namely input/output (I/O) connectors and interconnection connectors. The I/O connectors are employed in signal transmissions of main systems and peripherals of computers such as computer mice, monitors, keyboards, printers, graph plotters and network systems. Related products include circular connectors, delta connectors and coaxial connectors. The interconnection connectors are applied within main systems and peripherals, and serve as links between carriers of electronic components and electronic signals of modules in various systems. Related products include integrated circuit sockets, cardedge connectors and flat cables. Owing to miniaturization and precision trends of electronic products, it is essential that designs of connectors become sophisticated as well for reaching qualities of having zero malfunction and being maintenance-free. Therefore, conducting terminals at the connectors also need to be collocated with high-quality designs.

Referring to a prior electric connector disclosed in the Taiwan Patent No. 509406, an electric connector 10 comprises a signal terminal 11 and a ground terminal 13, which are both disposed in a cavity at an interior of each of housing-like insulation bodies 12, and are fastened at each of the insulation bodies 12 using stress produced by materials of the terminals and deformation of the terminals occurred during design process thereof. Referring to FIG. 2, the terminal 11 has a U-shaped portion 14 at a top end thereof, an extension portion 15 connecting the U-shaped portion 14, a dentate fastening portion 16, and a contact portion 17 serving as an electrically conducting contact. Wherein, the U-shaped portion 14 is secured at an interior of the connector 10; the extension portion 15 is joined with an inner wall of the insulation body 12 so as to attach a flip arm thereof at an appropriate position; the fastening portion 16 is attached to the insulation body 12 using the dentate structure thereof; and the contact portion 17 is connected to an exterior power supply or a connector for electric conductivity, and is capable of adjusting electricity of the terminal to required standards using an elongated portion thereof. Referring to FIG. 3, the ground terminal 13 is also designed to adapt to the electric connector 10 and has a shape similar to that of the signal terminal 11, and therefore shall not be unnecessarily described. The signal terminal 11 shown in FIG. 2 and the ground terminal shown in FIG. 3 are installed and thus make up the electric connector 10 as indicated in FIG. 1.

According to the prior art, terminals are formed by stamping, and are bent to change shapes thereof for accommodating connector elements in coordination with electricity. However, because the bent portions are not exactly stable structures, material stress thereof produced is not suitable for various applications, and sometimes damages are even resulted from unexpected elastic forces thereof. Hence, the invention provides a conducting terminal structure made of a formed integral, which offers a structure stability of the entire structure, and also accomplishes securing and electric conductivity purposes using the structure thereof.

SUMMARY OF THE INVENTION

The object of the invention is to provide a conducting terminal structure made of a formed integral for avoiding instability of the structure due to stress produced by bent portions thereof, and being capable reinforcing securing effects thereof within a connector. The conducting terminal comprises a contact portion for conducting electricity, a fastening portion having dentate shape for attaching to the connector, a tenon portion for inserting and fastening into the connector, and an extension portion as an elongation of the terminal for coordinating with the structure of the connector.

DETAILED DESCRIPTION OF THE PREFERRED EMBODIMENTS

To better understand the invention, detailed descriptions shall be given with the accompanying drawings hereunder.

Figure 1:
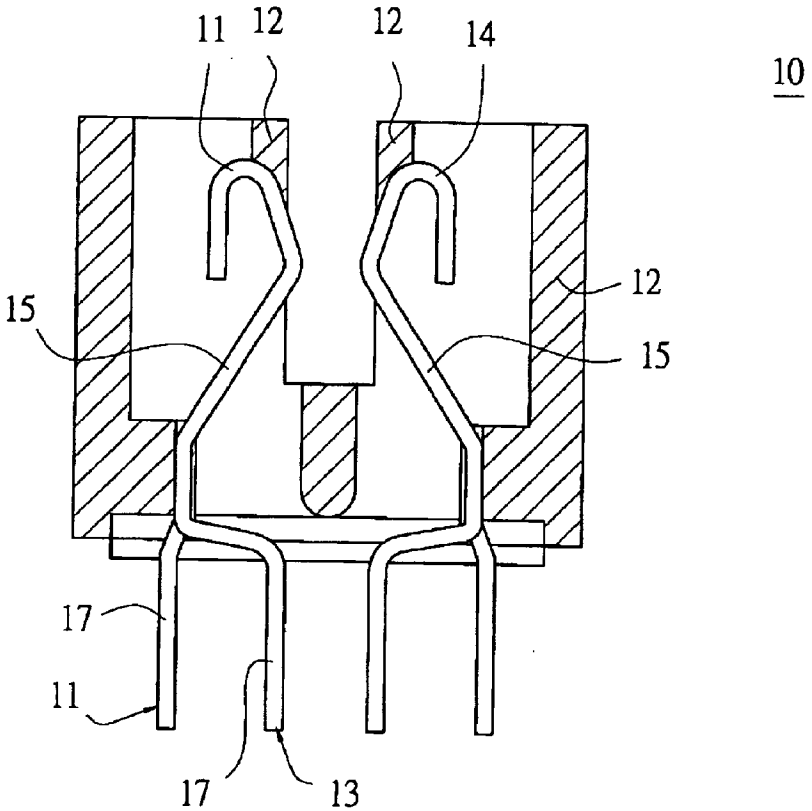
FIG.1 PRIOR ART
FIG. 1 shows a conventional sectional view of a prior electric connector.
Figure 2:
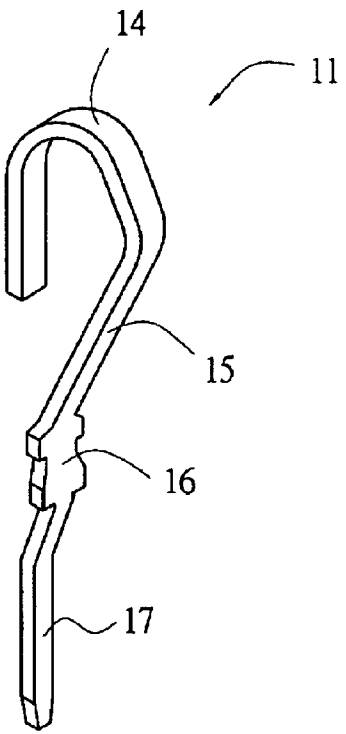
FIG.2 PRIOR ART
FIG. 2 shows a conventional elevational view illustrating a signal terminal of a prior electric connector.
Figure 3:
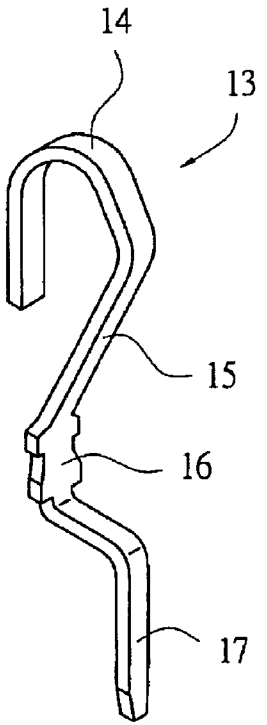
FIG.3 PRIOR ART
FIG. 3 shows a conventional elevational view illustrating a ground terminal of a prior electric connector.
Figure 4:
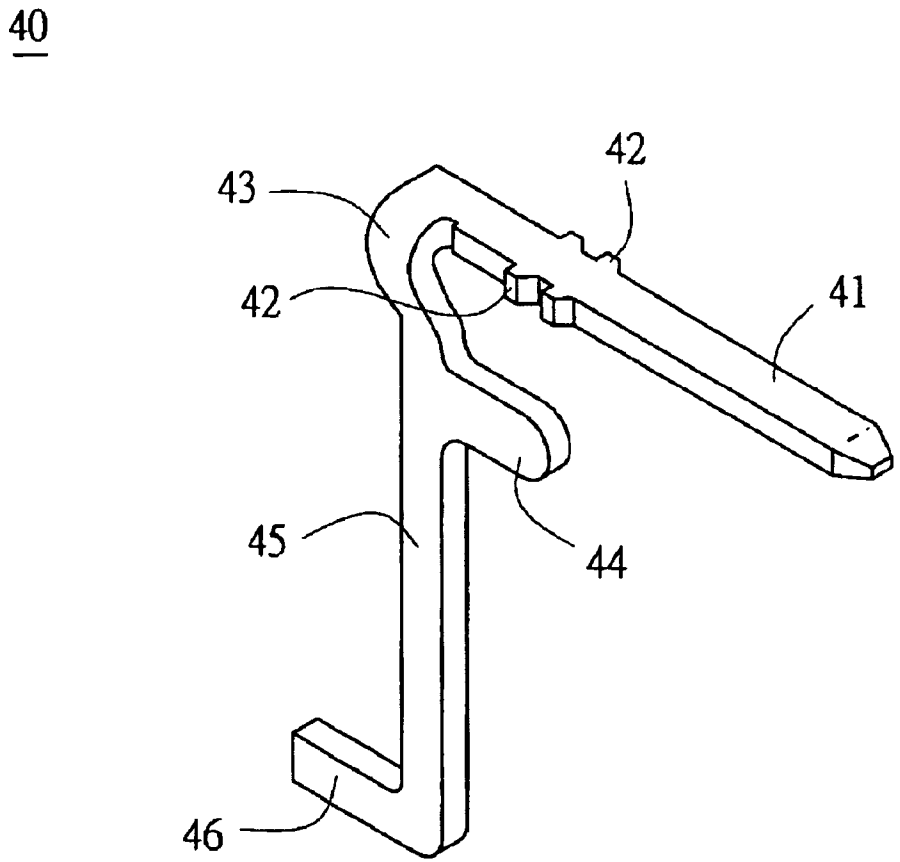
FIG. 4 shows an elevational structural view of a first conducting terminal in an embodiment according to the invention.

Referring to FIG. 4 showing an elevational structural view of a first conducting terminal 40 in an embodiment according to the invention, the conducting terminal 40 is made of a formed integral from metal materials, and various parts thereof are shaped by molds. Instability issues of stress are not caused by bent portions thereof, and thus ensuring stability and strength of the entire structure. In addition, because of certain elasticity maintained by the metal material thereof, the structure is suitable for securing to a connector to function as a conducting terminal.

The first conducting terminal 40 comprises a first contact portion 41 serving as an electrically conducting portion connected with a connector; a first fastening portion 42 having a dentate shape for securing to the connector and reinforcing securing effects within in the connector; a first bent portion 43 for coordinating a structure of the connector, and having a curved portion capable of strengthening the structure of the terminal for further preventing deformation; a first tenon portion 44 protruding at a center of the first conducting terminal 40, and for inserting into and fastening to the connector; a first extension portion 45 as an elongation of the first conducting terminal 40, and for adapting to the structure of the connector; and a first fastening bottom portion 46 formed as an end of the terminal, and being adjustable in size for coordinating with the structure of the connector. The first conducting terminal 40 is secured to the connector via the first fastening portion 42 and the first tenon portion 44. For that the first bent portion 43 is a formed integral, a structural issue such as stress rebound is not incurred, thereby reinforcing stability of the entire structure of the conducting terminal.

Figure 5:
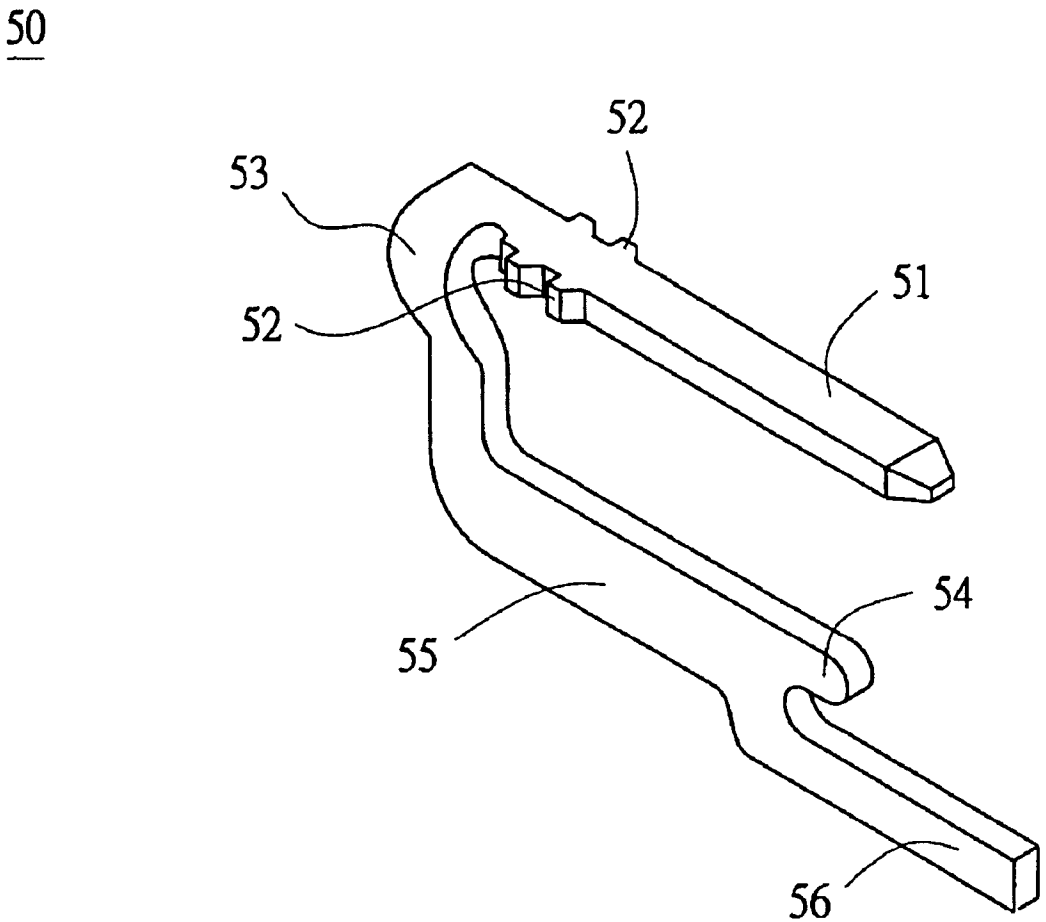
FIG. 5 shows an elevational structural view of a second conducting terminal in an embodiment according to the invention.

Referring to FIG. 5 showing an elevational structural view of a second conducting terminal 50 in an embodiment according to the invention, the second conducting terminal 50 is designed according to the first conducting terminal 40 to form two conducting terminals of the connector. The second conducting terminal 50 comprises a second contact portion 51 serving as an electrically conducting portion; a second fastening portion 52 having a dentate shape for securing to the connector and reinforcing securing effects within in the connector; a second bent portion 53 for strengthening the structure of the terminal; a second tenon portion 54 for inserting into and fastening to the connector; a second extension portion 55 as an elongation of the second conducting terminal 50, and for adapting to the structure of the connector; and a second fastening bottom portion 56. The second conducting terminal 50 is secured to the connector via the second fastening portion 52 and the second tenon portion 54. For that the second bent portion 53 is a formed integral, a structural issue such as stress rebound is not incurred, thereby reinforcing stability of the entire structure of the conducting terminal.

Several examples with respect to the aforesaid conducting terminal structure shall be illustrated below. However, it is to be understood that the invention is not limited within these examples.

Figure 6:
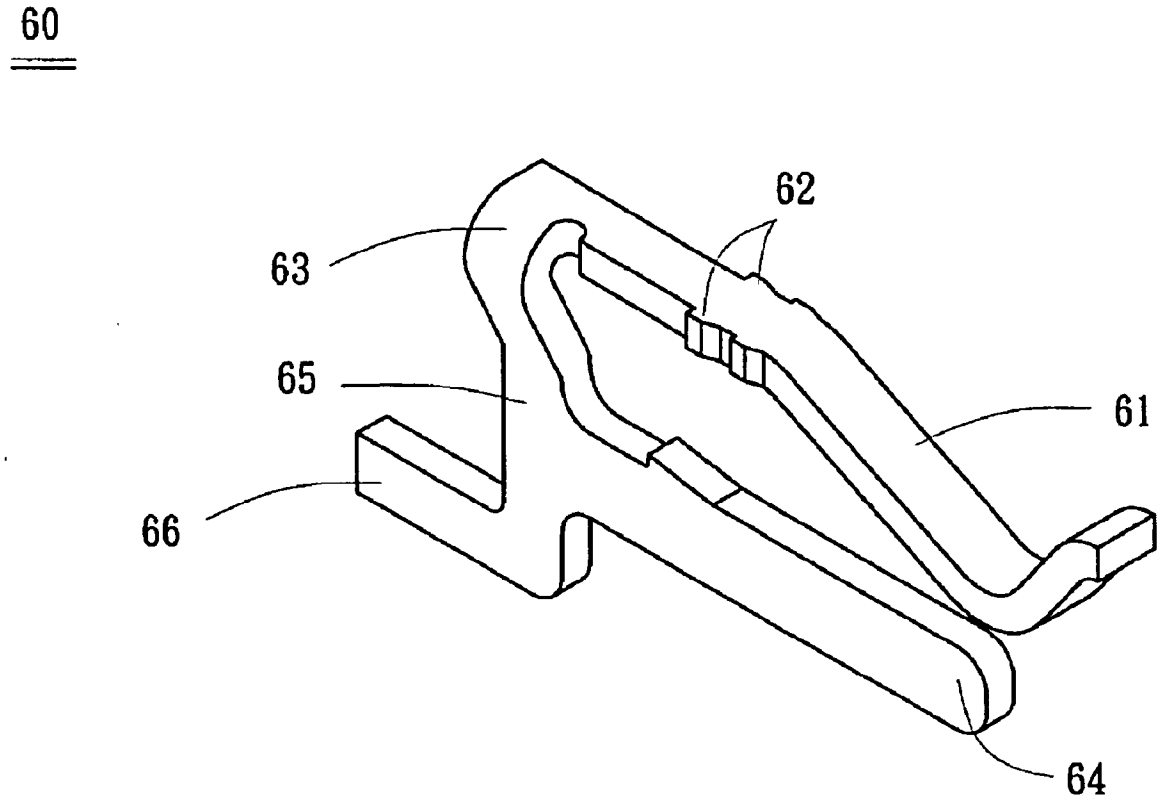
FIG. 6 shows an elevational structural view of a third conducting terminal in an embodiment according to the invention.

FIG. 6 shows an elevational structural view of a third conducting terminal 60 in an embodiment according to the invention, the third conducting terminal 60 comprises a third contact portion 61 serving as an electrically conducting portion and being bent downward in this embodiment, wherein the bent structure reinforces a status of electric conductivity and provides clamping and binding effects when connecting to another connector; a third fastening portion 62 having a dentate shape for securing to the connector and reinforcing securing effects within in the connector; a third bent portion 63 having a curved portion for strengthening the structure of the terminal; a third tenon portion 64 as a protruding structure for inserting into and fastening to the connector; a third extension portion 65 as an elongation of the third conducting terminal 60 having an adjustable size for adapting to the structure of the connector; and a third fastening bottom portion 66. The third conducting terminal 60 is secured to the connector via the third fastening portion 62 and the third tenon portion 64. For that the third bent portion 63 is a formed integral, a structural issue such as stress rebound is not incurred, thereby reinforcing stability of the entire structure of the conducting terminal.

Figure 7:
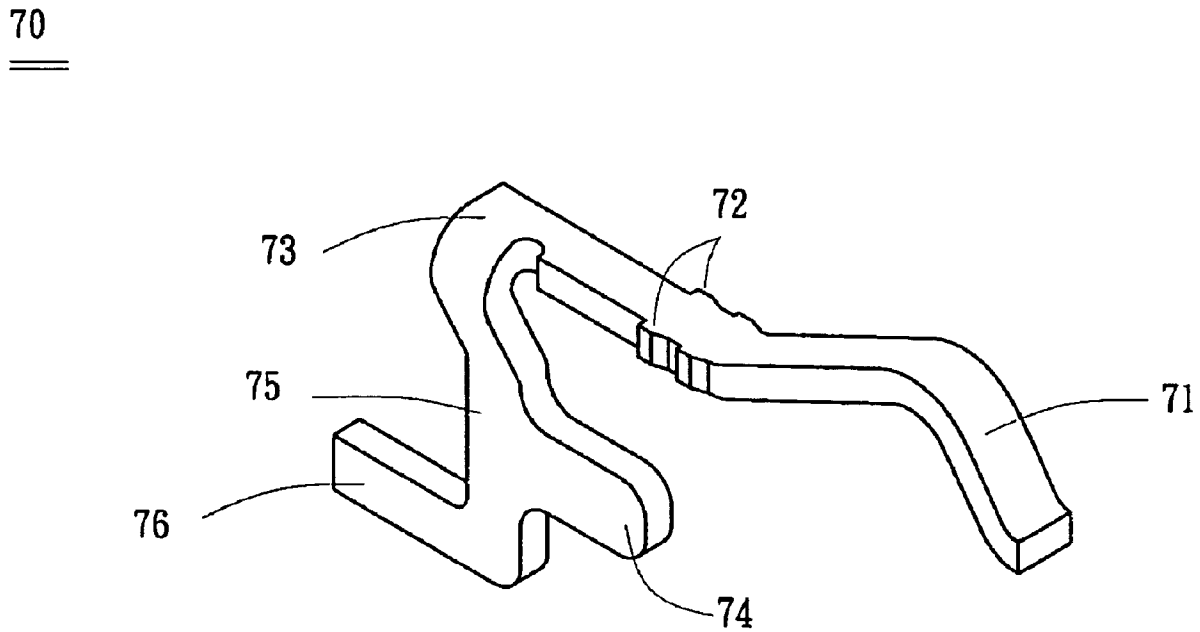
FIG. 7 shows an elevational structural view of a fourth conducting terminal in an embodiment according to the invention.

FIG. 7 shows an elevational structural view of a fourth conducting terminal 70 in an embodiment according to the invention, the fourth conducting terminal 70 comprises a fourth contact portion 71 serving as an electrically conducting portion and being bent upward in this embodiment, wherein the bent structure reinforces a status of electric conductivity and provides clamping and binding effects when connecting to another connector; a fourth fastening portion 72 having a dentate shape for securing to the connector and reinforcing securing effects within in the connector; a fourth bent portion 73 having a curved portion for strengthening the structure of the terminal; a fourth tenon portion 74 as a protruding structure for inserting into and fastening to the connector; a fourth extension portion 75 as an elongation of the fourth conducting terminal 70 and having an adjustable size for adapting to the structure of the connector; and a fourth fastening bottom portion 77 variable to coordinate with the structure of the connector. The fourth conducting terminal 70 is secured to the connector via the fourth fastening portion 72 and the fourth tenon portion 74. For that the fourth bent portion 73 is a formed integral, a structural issue such as stress rebound is not incurred, thereby reinforcing stability of the entire structure of the conducting terminal.

Figure 8:
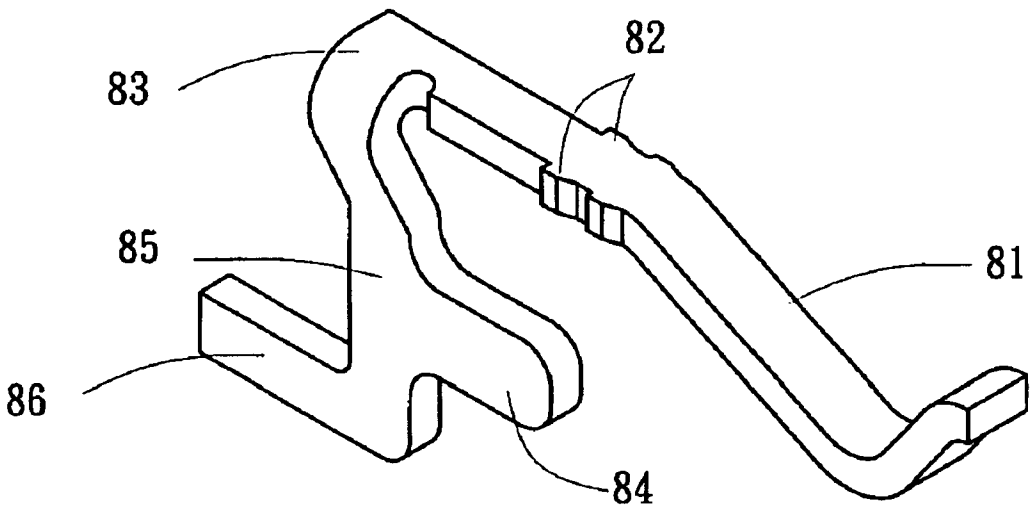
FIG. 8 shows an elevational structural view of a fifth conducting terminal in an embodiment according to the invention.

FIG. 8 shows an elevational structural view of a fifth conducting terminal 80 in an embodiment according to the invention, the fifth conducting terminal 80 comprises a fifth contact portion 81 serving as an electrically conducting portion and being bent upward and extended in this embodiment, wherein the bent structure reinforces a status of electric conductivity and provides clamping and binding effects when connecting to another connector; a fifth fastening portion 82 having a dentate shape for securing to the connector and reinforcing securing effects within in the connector; a fifth bent portion 83 having a curved portion for strengthening the structure of the terminal; a fifth tenon portion 84 as a protruding structure for inserting into and fastening to the connector; a fifth extension portion 85 as an elongation of the fifth conducting terminal 80 and having an adjustable size for adapting to the structure of the connector; and a fifth fastening bottom portion 88 variable to coordinate with the structure of the connector. The fifth conducting terminal 80 is secured to the connector via the fifth fastening portion 82 and the fifth tenon portion 84. For that the fifth bent portion 83 is a formed integral, a structural issue such as stress rebound is not incurred, thereby reinforcing stability of the entire structure of the conducting terminal.

Figure 9:
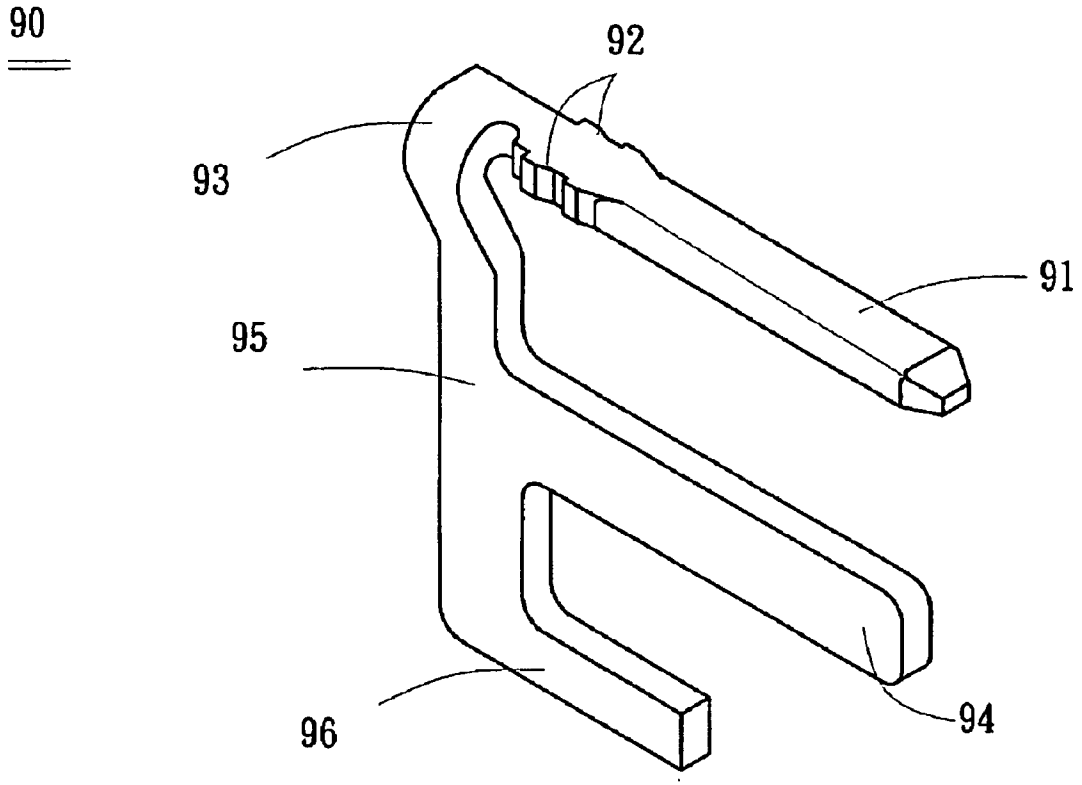
FIG. 9 shows an elevational structural view of a sixth conducting terminal in an embodiment according to the invention.

FIG. 9 shows an elevational structural view of a sixth conducting terminal 90 in an embodiment according to the invention, the sixth conducting terminal 90 comprises a sixth contact portion 91 serving as an electrically conducting portion, being long and straight in shape in this embodiment, and designed to coordinate with the connector; a sixth fastening portion 92 having a dentate shape for securing to the connector and reinforcing securing effects within in the connector; a sixth bent portion 93 having a curved portion for strengthening the structure of the terminal; a sixth tenon portion 94 as a protruding structure for inserting into and fastening to the connector; a sixth extension portion 95 as an elongation of the sixth conducting terminal 90 and having an adjustable size for adapting to the structure of the connector; and a sixth fastening bottom portion 99 variable to coordinate with the structure of the connector. The sixth conducting terminal 90 is secured to the connector via the sixth fastening portion 92 and the sixth tenon portion 94. For that the sixth bent portion 93 is a formed integral, a structural issue such as stress rebound is not incurred, thereby reinforcing stability of the entire structure of the conducting terminal.

Figure 10:
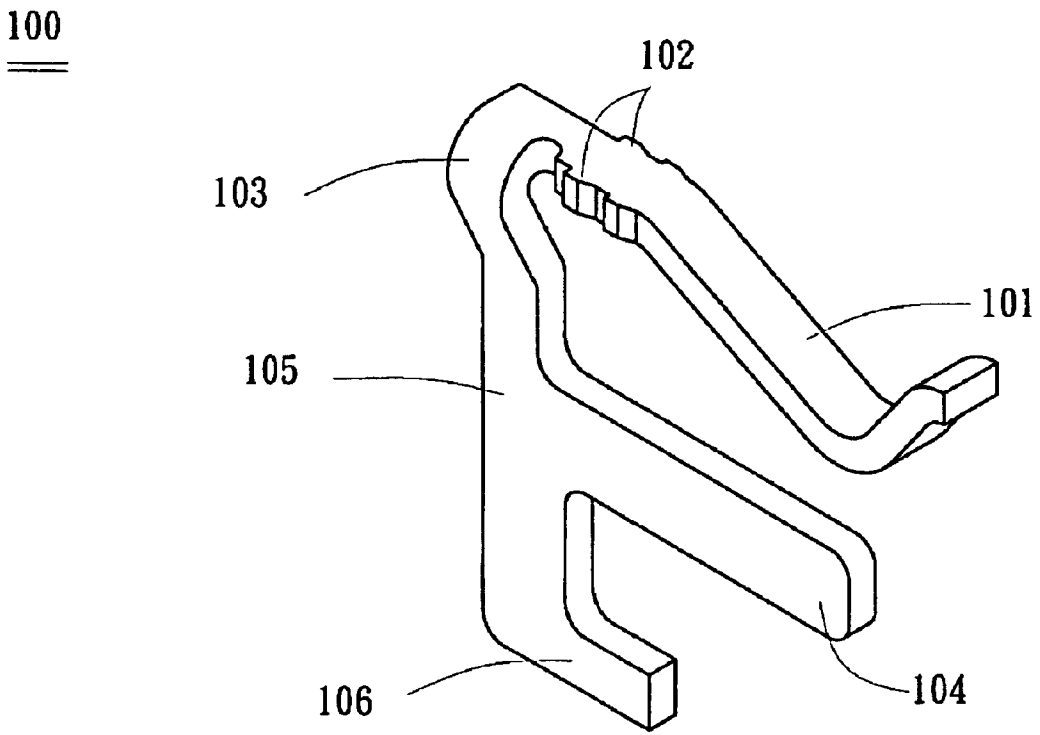
FIG. 10 shows an elevational structural view of a seventh conducting terminal in an embodiment according to the invention.

FIG. 10 shows an elevational structural view of a seventh conducting terminal 100 in an embodiment according to the invention, the seventh conducting terminal 100 comprises a seventh contact portion 101 serving as an electrically conducting portion and being bent downward in this embodiment in order to reinforce effects of electric conductivity, and designed for coordinating with the connector; a seventh fastening portion 102 having a dentate shape for securing to the connector and reinforcing securing effects within in the connector; a seventh bent portion 103 having a curved portion for strengthening the structure of the terminal; a seventh tenon portion 104 as a protruding structure for inserting into and fastening to the connector; a seventh extension portion 105 as an elongation of the seventh conducting terminal 100 and having an adjustable size for adapting to the structure of the connector; and a seventh fastening bottom portion 1010 variable to coordinate with the structure of the connector. The seventh conducting terminal 100 is secured to the connector via the seventh fastening portion 102 and the seventh tenon portion 104. For that the seventh bent portion 103 is a formed integral, a structural issue such as stress rebound is not incurred, thereby reinforcing stability of the entire structure of the conducting terminal.

Figure 11:
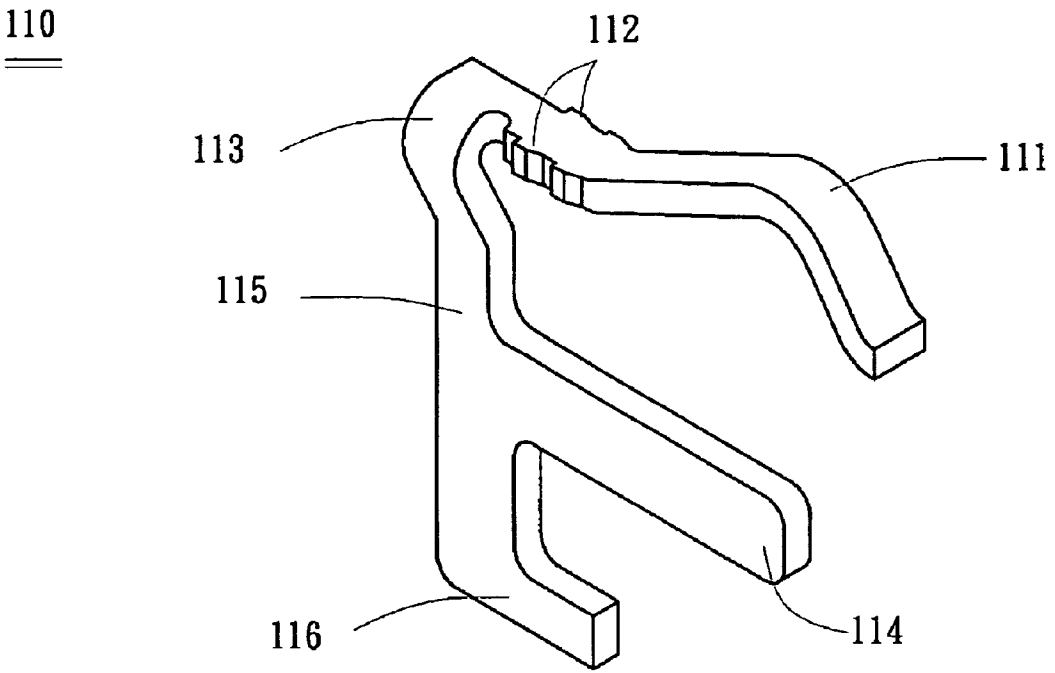
FIG. 11 shows an elevational structural view of an eighth conducting terminal in an embodiment according to the invention.

FIG. 11 shows an elevational structural view of an eighth conducting terminal 110 in an embodiment according to the invention, the eighth conducting terminal 110 comprises an eighth contact portion 111 serving as an electrically conducting portion and being bent upward in this embodiment in order to reinforce effects of electric conductivity, and designed for coordinating with the connector; an eighth fastening portion 112 having a dentate shape for securing to the connector and reinforcing securing effects within in the connector; an eighth bent portion 113 having a curved portion for strengthening the structure of the terminal; an eighth tenon portion 114 as a protruding structure for inserting into and fastening to the connector; an eighth extension portion 115 as an elongation of the eighth conducting terminal 110 and having an adjustable size for adapting to the structure of the connector; and an eighth fastening bottom portion 1111 variable to coordinate with the structure of the connector. The eighth conducting terminal 110 is secured to the connector via the eighth fastening portion 112 and the eighth tenon portion 114. For that the eighth bent portion 113 is a formed integral, a structural issue such as stress rebound is not incurred, thereby reinforcing stability of the entire structure of the conducting terminal.

Figure 12:
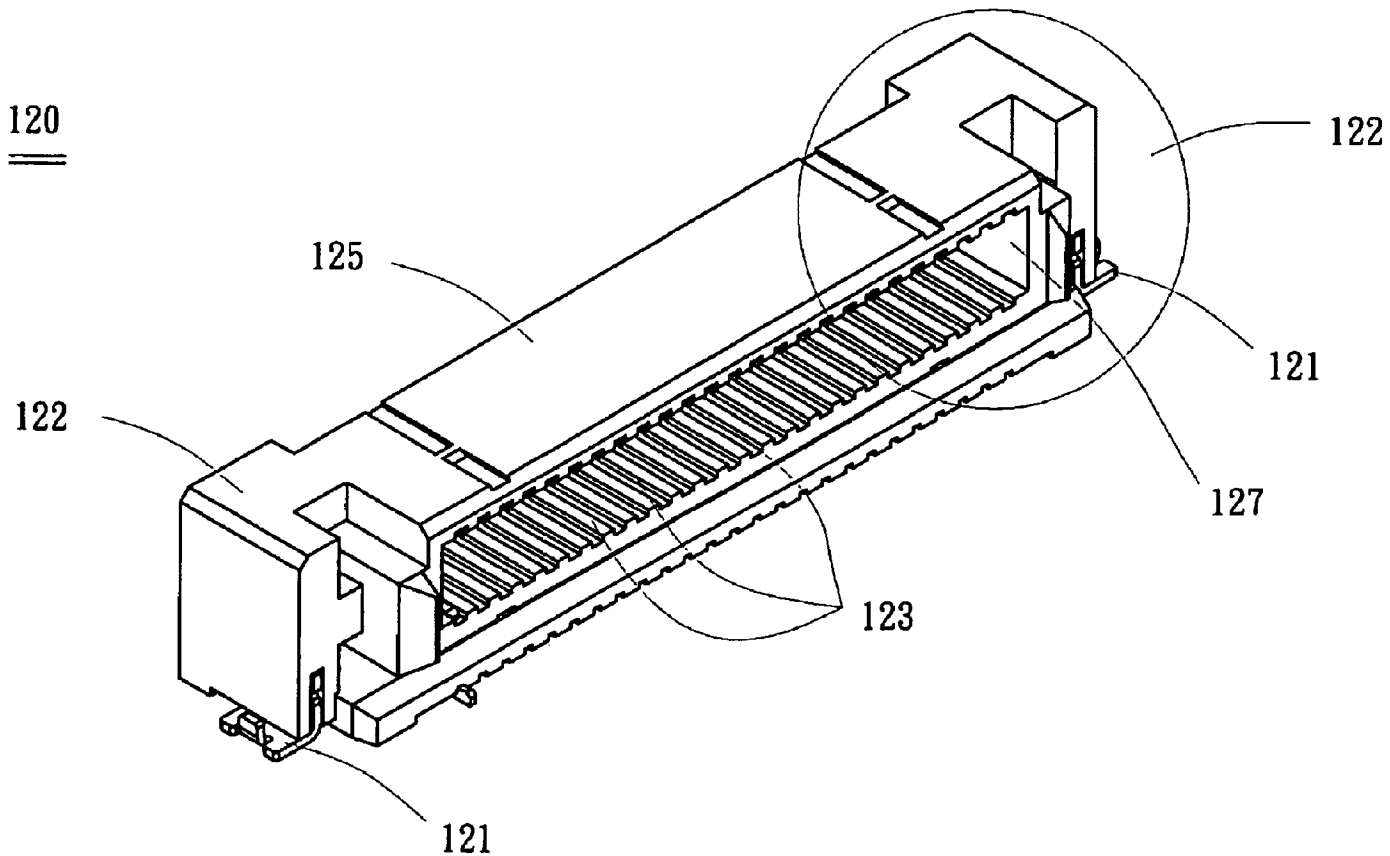
FIG. 12 shows an elevational view of the connector in an embodiment according to the invention.

Referring to FIG. 12 showing an elevational view of the connector in an embodiment according to the invention, all the conducting terminals described in the aforesaid examples are utilized in a connector 120 shown in the diagram. The connector 120 comprises a recess 127, a recess wall 125 made of insulation materials, and at least one joining mechanism 122. Wherein the recess 127 is designed to connect to another joining mechanism, and is disposed with a plurality of conducting terminal grooves 123 for contacting conducting devices of another joining mechanism for further transmitting electric signals. An entire structure of the connector 120 is mainly consisted of the recess wall 125 made of insulation materials, and has a joining mechanism 122 at two sides thereof, respectively, so as to join to another joining mechanism. The joining mechanism 122 is designed in coordination with members of the connector for detaining and fastening with one another. The joining mechanism 122 is further provided with a plurality of fastening mechanisms 121 for connecting and fastening with other peripherals.

Figure 13A:
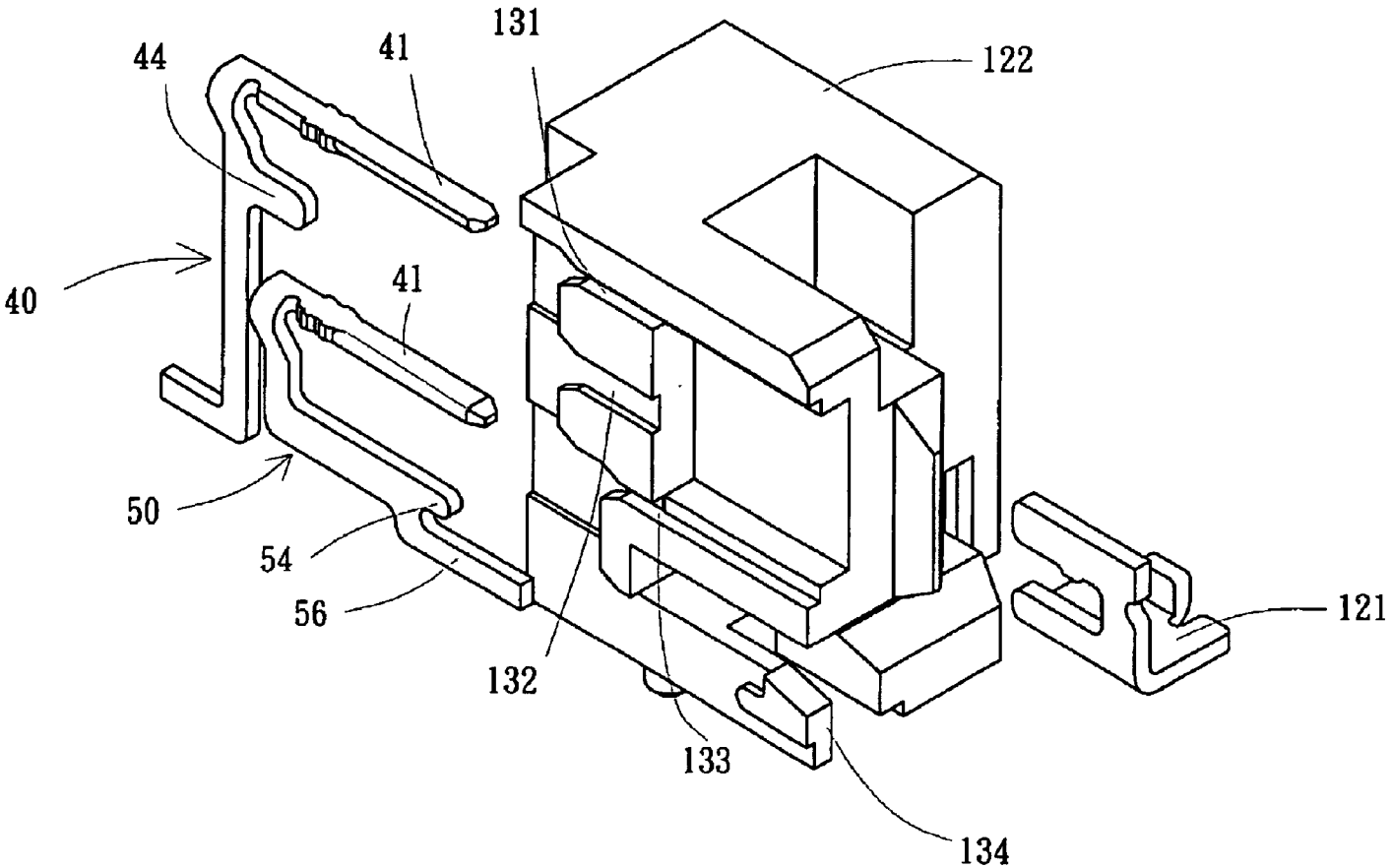
FIG. 13A shows a sectional view illustrating the conducting terminal of the connector being connected in an embodiment according to the invention.

Referring to FIG. 13A showing a sectional view illustrating the conducting terminal of the connector being connected in an embodiment according to the invention, the joining mechanism 122 next to the connector is designed in connection with another joining mechanism, and connections between the first conducting terminal 40 and the second conducting terminal 50 are as shown in the diagram. The first portion 41 of the first conducting terminal 40 is aligned with and fastened into a first sliding track 131 at the joining mechanism 122. The first tenon portion 44 is aligned with and fastened into a second sliding track 132 at the joining mechanism 122. The second contact portion 52 of the second conducting terminal 50 is aligned with and fastened into a third sliding track 133. The second tenon portion 54 and the second fastening portion 56 are aligned with and fastened into two sides of a projecting fastening portion 134. Two conducting terminals in the connector are thus formed by the first conducting terminal 40 and the second conducting terminal 50. One side of the joining mechanism 122 is connected and fixed to the joining mechanism 122 in order to join another fastening base.

Figure 13B:
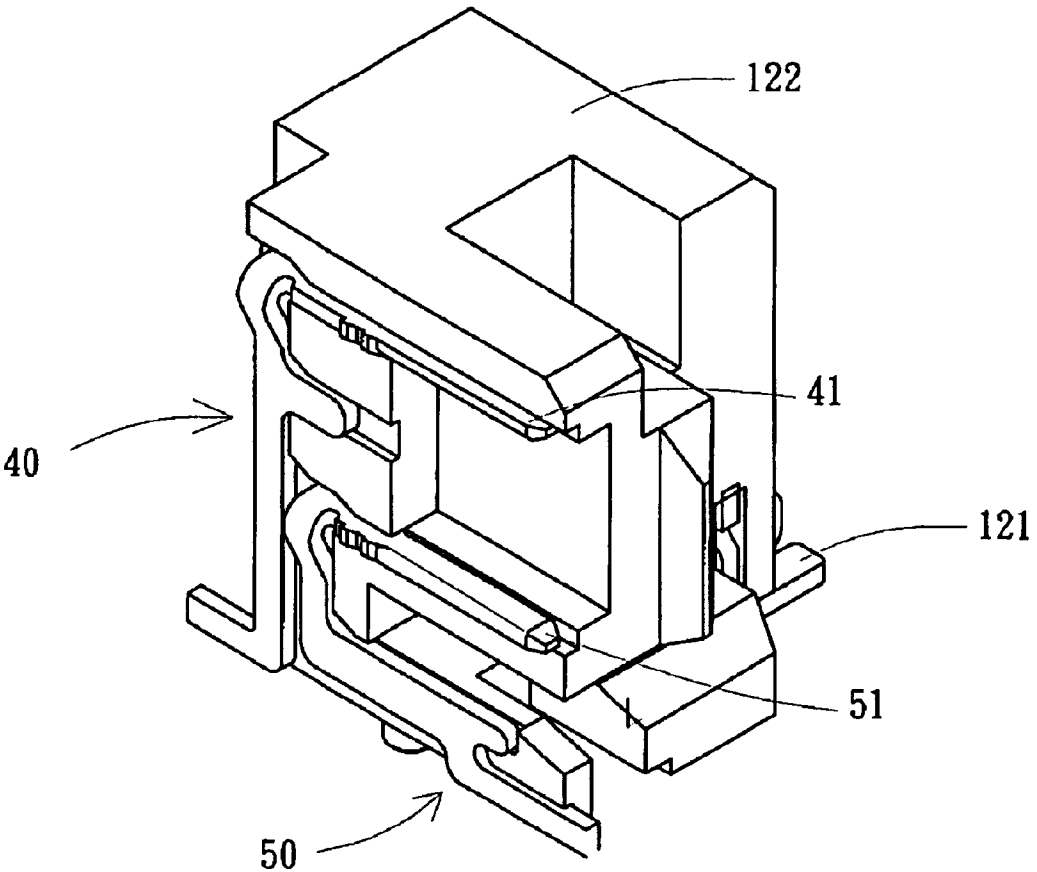
FIG. 13B shows a sectional view illustrating the conducting terminal of the connector having been connected in an embodiment according to the invention.

Referring to FIG. 13B showing a sectional view illustrating the conducting terminal of the connector having been connected in an embodiment according to the invention, the first conducting terminal 40 and the second conducting terminal 50 are fastened to the joining mechanism 122 along the plurality of sliding tracks. In addition, the first contact portion 41 of the first conducting terminal 40 and the second contact portion 51 of the second conducting terminal 50 function as conducting terminals of the connector.

From the conducting terminal structure according to the invention, it is observed that the conducting terminal formed as an integral is capable of maintaining structural stability, and reinforcing securing effects using a plurality of fastening mechanisms disposed.

It is of course to be understood that the embodiments described herein are merely illustrative of the principles of the invention and that a wide variety of modifications thereto may be effected by persons skilled in the art without departing from the spirit and scope of the invention as set forth in the following claims.

What is claimed is:

1. A conducting terminal structure for use with a connector comprising:

at least one contact terminal having:

a) a contact portion;

b) an extension portion;

c) a fastening portion located between the contact portion and the extension portion and including a plurality of protruding teeth; and d) a tenon portion located adjacent to and protruding from the extension portion;

wherein the fastening portion and the tenon portion connect the at least one contact terminal to the connector.

2. The conducting terminal structure according to claim 1, further comprising a bent portion located between the fastening portion and the extension portion.

3. The conducting terminal structure according to claim 1, further comprising a bottom portion located adjacent to and protruding from the extension portion.

4. The conducting terminal structure according to claim 1, wherein the conducting terminal structure is made of metal.

5. The conducting terminal structure according to claim 1, wherein the connector includes:

a) a recess having a plurality of conducting terminal grooves into which the at least one contact terminal is inserted;

b) a recess wall insulating the recess; and c) at least one joining mechanism connecting and fastening to peripheral devices.

* * * * *